US007774984B2

(12) United States Patent
Hsu

(10) Patent No.: US 7,774,984 B2
(45) Date of Patent: Aug. 17, 2010

(54) CONCENTRIC CROSS MECHANISM FOR TRANSITING TORSION

(75) Inventor: Chun-Pu Hsu, Taipei County (TW)

(73) Assignee: Eledyna Technology Corporation, Vancouver, British Columbia (CA)

( * ) Notice: Subject to any disclaimer, the term of this patent is extended or adjusted under 35 U.S.C. 154(b) by 538 days.

(21) Appl. No.: 11/829,495

(22) Filed: Jul. 27, 2007

(65) Prior Publication Data

US 2009/0025297 A1 Jan. 29, 2009

(51) Int. Cl.
*E05F 11/24* (2006.01)

(52) U.S. Cl. ..... 49/341; 49/324; 49/326; 49/339; 49/340; 74/423; 185/40 R

(58) Field of Classification Search ..... 49/333, 49/334, 335, 338, 339, 340, 341, 326, 324; 74/423; 185/40 R
See application file for complete search history.

(56) References Cited

U.S. PATENT DOCUMENTS 3,874,117 A * 4/1975 Boehm ..... 49/264
4,045,914 A * 9/1977 Catlett ..... 49/334
4,220,051 A * 9/1980 Catlett ..... 74/89.25
4,333,270 A * 6/1982 Catlett ..... 49/336
4,658,545 A * 4/1987 Ingham et al. ..... 49/340
4,727,679 A * 3/1988 Kornbrekke et al. ..... 49/138
5,036,620 A * 8/1991 Beran et al. ..... 49/141
5,221,239 A * 6/1993 Catlett ..... 475/342
6,336,294 B1 * 1/2002 Kowalczyk et al. ..... 49/339
6,481,160 B1 * 11/2002 Kowalczyk ..... 49/335
6,530,178 B1 * 3/2003 Kowalczyk et al. ..... 49/334
6,786,006 B2 * 9/2004 Kowalczyk et al. ..... 49/334
2005/0178066 A1 * 8/2005 Drux et al. ..... 49/340

* cited by examiner

*Primary Examiner*—Jerry Redman
(74) *Attorney, Agent, or Firm*—Rosenberg, Klein & Lee

(57) ABSTRACT

A concentric cross mechanism for transiting torsion includes a main body unit of a concentric cross mechanism, a main body unit of the torsion-driven mechanism, a main body unit of the force-generating mechanism, and a restriction device. A center point is defined by crossing a vertical concentric axis and a horizontal concentric axis. The axle of the driven bevel gear and the scroll springs spin reversely with the axle of the torsion-generating bevel gear. The first bevel gear is provided for outputting the torsion on the upper and bottom ends thereof. Furthermore, when the rotary rod connected with one side of the torsion output axle is disposed between the positioning block and the positioning post, the door is driven by the other side of the torsion output axle to swing in a predetermined angle.

19 Claims, 12 Drawing Sheets

CONCENTRIC CROSS MECHANISM FOR TRANSITING TORSION

BACKGROUND OF THE INVENTION

1. Field of the Invention

The present invention relates to a concentric cross mechanism for transiting torsion, and in particular to a concentric cross mechanism used for an automatic door. The torsion generated by the force-generating mechanism is transmitted vertically and outputted to open the door. Furthermore, the torsion is outputted to scroll springs on the other side of the first bevel gear and a reversed torsion is restored in the scroll springs. The reversed torsion is released to close the door via the first bevel gear spinning in a reverse direction. The torsion generated by the force-generating mechanism and the reversed torsion restored to the scroll spring are respectively provided for opening and closing the door through the vertical axis and a center crossed by the vertical axis and a horizontal axis.

2. Description of Prior Art

A door is a barrier that swings or folds to close an opening in a wall. The door is installed as the entry point for a room or building to restrict access. Modern technology has seen many improvements to the original and simple design of a door, making them easier or harder to pass through, and offering additional functions.

However, according to practical experience, there is still a drawback existing in the traditional automatic door. A doorstop is formed on a wall or ground to hold the door open or closed. Moreover, the doorstop is an object or device to prevent the door from opening too widely. The doorstop is obviously an impediment that blocks the path of a person walking through the doorway.

Hence, the inventors of the present invention believe that the shortcomings described above are able to be improved upon and suggest the present invention which is of a reasonable design as an effective improvement based on extensive research and thought.

SUMMARY OF THE INVENTION

The primary object of the present invention is to provide a concentric cross mechanism for transiting torsion, which provides torsion and reversed torsion to the same horizontal axis and both two forces can be transmitted vertically so as to be outputted to two ends of a vertical axis, thereby efficiently swinging the door open or closing it.

Another object of the present invention is to provide the concentric cross mechanism for transiting torsion. The structure is provided for limiting the opening angle of the door. Accordingly, the doorstop is unnecessary for the structure of the door and a walker can walk safely through the doorway in an unimpeded manner.

In order to achieve the above objects, the present invention provides the concentric cross mechanism for transiting torsion comprising: a main body unit of the concentric cross mechanism, a main body unit of a torsion-driven mechanism, a main body unit of a force-generating mechanism, and a restriction device. The main body unit of the concentric cross mechanism comprises: a cross body, an upper cover disposed on an upper side of the cross body, a bottom cover disposed on a bottom side of the cross body, a torsion output axle disposed inside the cross body and corresponding to the upper cover and the bottom cover, and a first bevel gear mated with the torsion output axle. The main body unit of a torsion-driven mechanism is disposed on a side of the cross body, the main body unit of a torsion-driven mechanism comprises: a casing for the torsion-driven mechanism, an axle of the driven bevel gear disposed inside the casing for the torsion-driven mechanism, and at least one scroll spring disposed inside the casing for the torsion-driven mechanism that corresponds to the axle of the driven bevel gear. The main body unit of the force-generating mechanism is disposed on the other side of the cross body and corresponds to the main body unit of the torsion-driven mechanism. The main body unit of the force-generating mechanism comprises: an axle of the torsion-generating bevel gear, and a force-generating device connected to the axle of the torsion-generating bevel gear that acts as a power source thereto. The restriction device is disposed on either the upper cover or the bottom cover and corresponds to the torsion output axle. The restriction device comprises: a positioning block, a positioning post, and a rotary rod mated with the torsion output axle. The rotary rod is disposed between the positioning block and the positioning post so that the rotation angle of the rotary rod is limited.

A left side and a right side of the main body unit of the concentric cross mechanism respectively both have a hole and a horizontal concentric axis defined inside the horizontal space of the cross body via centers of the holes on the left side and the right side. Alternatively, middle portions of an upper side and a bottom side of the main body unit of the concentric cross mechanism respectively both have a hole, a vertical concentric axis being defined inside the vertical space of the cross body via centers of the holes on the upper side and the bottom side. A center point is defined by crossing the vertical concentric axis and the horizontal concentric axis.

The first bevel gear respectively mates with the axle of the torsion-generating bevel gear and the axle of the driven bevel gear. The axle of the torsion-generating bevel gear is opposite to the axle of the driven bevel gear and the two axles spin in opposite directions. Both the axle of the torsion-generating bevel gear and the axle of the driven bevel gear transit torsion to the first bevel gear. The first bevel gear outputs the torsion from an upper end and a bottom end of the torsion output axle.

The restriction device is disposed on an upper surface of the upper cover and corresponds to the torsion output axle. The restriction device comprises a positioning block, a positioning post, and a rotary rod corresponding to the torsion output axle. The rotary rod is disposed between the positioning block and the positioning posts so as to limit the rotary angle of the rotary rod. When the torsion output axle outputs torsion, the door is driven to open. Depending that the rotary rod connected to one side of the torsion output axle is disposed between the positioning block and the positioning post, the door is driven by the other side of the torsion output axle to swing to a predetermined angle.

Two concentric holes are respectively disposed on the left surface and right surface of the cross body and a horizontal concentric axis is defined by the centers of the two concentric holes. Two through holes are respectively disposed on the upper torsion-outputting end and the bottom torsion-outputting end and a vertical concentric axis is defined by the centers of the two through holes. Furthermore, a center point is defined by crossing the vertical concentric axis and the horizontal concentric axis.

The first bevel gear respectively mates with the axle of the driven bevel gear and the axle of the torsion-generating bevel gear. The axle of the torsion-generating bevel gear spins in a direction opposite to the rotary direction of the axle of the driven bevel gear in view of the center point so that torsion is transited to the first bevel gear. Moreover, the torsion is outputted by the upper and the bottom ends of the first bevel gear.

Accordingly, a door is driven to be opened by one end of the torsion output axle and the other end of the torsion output axle is connected with the restriction device. Furthermore, the rotary rod spins simultaneously with the door. The opened angle of the door is limited because the rotary rod is restricted between the positioning block and the positioning posts.

The present invention has the following benefits. The door is opened or closed efficiently because of the concentric cross mechanism and the structure is simplified. With the present invention, the size of the entire structure can also be reduced.

Moreover, the structure of the concentric cross mechanism can be modified to achieve a left hand door or a right hand door so that a user can pull or push the door to open it.

In order to better understand the characteristics and technical contents of the present invention, a detailed description thereof will be made with reference to the accompanying drawings. However, it should be understood that the drawings and the description are illustrative but should not be used to limit the scope of the present invention.

DETAILED DESCRIPTION OF THE INVENTION

Figure 1:
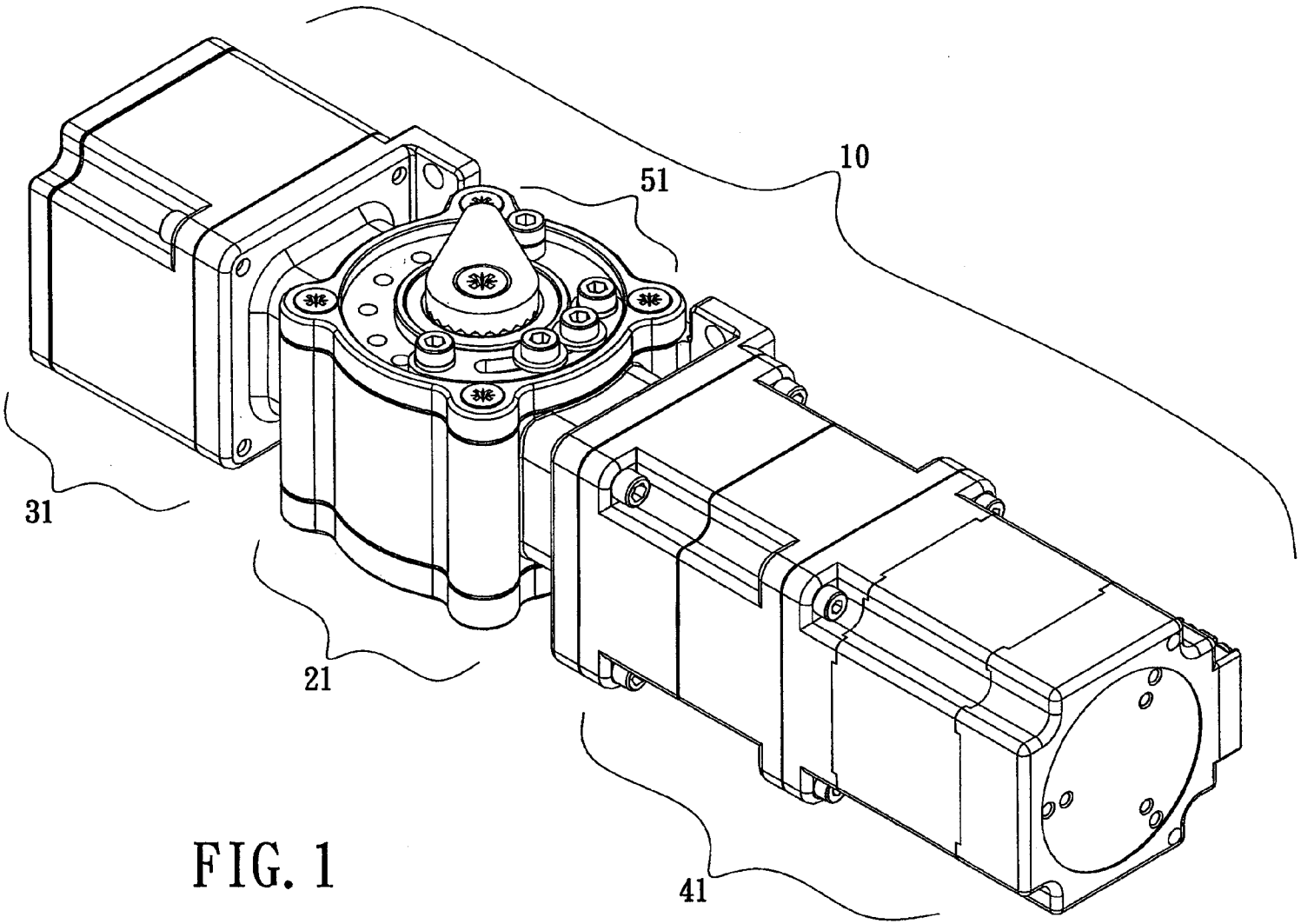
FIG. 1 is an assembled perspective view showing the concentric cross mechanism of the present invention.
Figure 2:
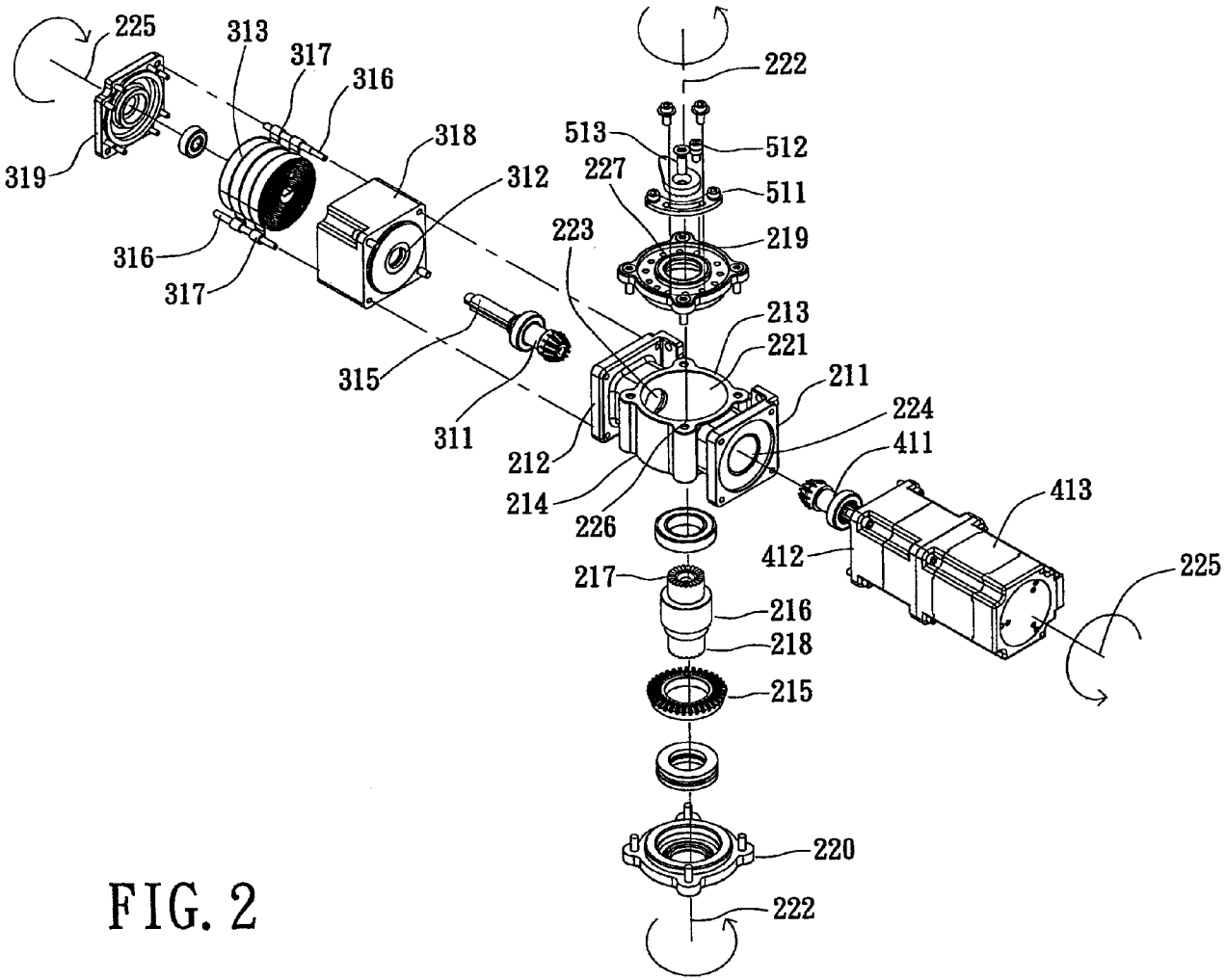
FIG. 2 is an exploded perspective view showing the concentric cross mechanism of the present invention.

With reference to FIGS. 1 to 12, the first embodiment of the present invention is shown. The present invention provides a concentric cross mechanism for a transiting torsion 10 as shown in FIG. 1, which comprises a main body unit of the concentric cross mechanism 21, a main body unit of a torsion-driven mechanism 31, a main body unit of a force-generating mechanism 41, and a restriction device 51.

Please refer to FIGS. 2 to 5. The main body unit of the concentric cross mechanism 21 has a cross body, and a force-generating input end 211 is disposed on a right side thereof. Moreover, a force-driven input end 212, an upper torsion-outputting end 213, and a bottom torsion-outputting end 214 are respectively disposed on a left side, an upper side, and a bottom side of the cross body. A vertical through hole 221 penetrates through the cross body from the upper torsion-outputting end 213 to the bottom torsion-outputting end 214, and a vertical concentric axis 222 is defined inside the vertical through hole 221. A left hole 223 and a right hole 224 are respectively disposed on the left surface and right surface of the cross body and the left hole 223 and the right hole 224 communicate with each other to form a horizontal space. A horizontal concentric axis 225 is defined inside the horizontal space. Furthermore, a center point 226 is defined by crossing the vertical concentric axis 222 and the horizontal concentric axis 225 and the torsion is transmitted simultaneously and correspondingly to the center point 226. A horizontal torsion can be transited and transferred into a vertical torsion via the center point 226.

A bevel gear mechanism is disposed inside the cross body and the bevel gear mechanism comprises a first bevel gear 215 and a torsion output axle 216. The first bevel gear 215 corresponds to the torsion output axle 216. In this embodiment, the first bevel gear 215 is assembled with the torsion output axle 216 so as to simultaneously spin with the torsion output axle 216. An upper output end 217 and a bottom output end 218 are respectively formed on the upper end and the bottom end of the torsion output axle 216. The main body unit of the concentric cross mechanism 21 further comprises an upper cover 219 disposed on the upper side thereof for covering the upper torsion-outputting end 213 and a bottom cover 220 disposed on the bottom side thereof for covering the bottom torsion-outputting end 214. The torsion output axle 216 is fixed between the upper cover 219 and the bottom cover 220, and the torsion output axle 216 corresponds to the vertical through hole 221. As mentioned above, the first bevel gear 215 and the torsion output axle 216 spin simultaneously and coaxially on the vertical concentric axis 222.

The main body unit of the torsion-driven mechanism 31 is disposed on the force-driven input end 212 of the cross body. The main body unit of the torsion-driven mechanism 31 comprises an axle of the driven bevel gear 311, at least one scroll spring 313, two fixing elements 316 for positioning the scroll springs 313, a casing for the torsion-driven mechanism 318 and a cover of a torsion-driven mechanism 319. In the embodiment, four scroll springs 313 are assembled as a set of scroll springs. The axle of the driven bevel gear 311 is disposed inside the casing for the torsion-driven mechanism 318 and the front end of the axle of the driven bevel gear 311 protrudes from the output end 312 of the casing for the torsion-driven mechanism 318 so as to insert the axle of the driven bevel gear 311 into the left hole 223 of the main body unit of the concentric cross mechanism 21. The axle of the driven bevel gear 311 is meshed with the first bevel gear 215 at ninety degrees in order to spin correspondingly to the first bevel gear 215 so as to force torsion on and close the door.

In the present invention, an inner portion 314 of each scroll spring 313 is connected with a connecting end of a driven axle 315 of the driven bevel gear 311 so that they can spin simultaneously. The fixing elements 316 are respectively connected to the fixing portion 317 of the scroll spring 313 to position the scroll springs 313.

Moreover, the cover of a torsion-driven mechanism 319 is provided for fixing the fixing elements 316 and the scroll springs 313 inside the casing for the torsion-driven mechanism 318. The scroll springs 313 save a predetermined elastic torsion when the scroll springs 313 spin correspondingly to the axle of the driven bevel gear 311. The predetermined elastic torsion saved in the scroll springs 313 can be released by reversely rotating the axle of the driven bevel gear 311 and the first bevel gear 215 so as to spin in a reverse direction the torsion output axle 216 in order to close the door.

The main body unit of the force-generating mechanism 41 is disposed on the force-generating input end 211 of the cross body. The main body unit of the force-generating mechanism 41 comprises an axle of the torsion-generating bevel gear 411 and a force-generating device 413 with double-way and coaxial operations. The force-generating device 413 is connected with the axle of the torsion-generating bevel gear 411 and provides a power source for the axle of the torsion-generating bevel gear 411. The front end of the axle of the torsion-generating bevel gear 411 protrudes from the connecting end of torsion-generating axle 412 of the force-generating device 413 so as to insert the axle of the torsion-generating bevel gear 411 into the right hole 224 of the main body unit of the concentric cross mechanism 21. The axle of the torsion-generating bevel gear 411 is meshed with the first bevel gear 215 at ninety degrees in order to spin correspondingly to the first bevel gear 215. The force-generating device 413 is connected with the connecting end of the torsion-generating axle 412 of the axle of the torsion-generating bevel gear 411 so as to transit the power provided by the force-generating device 413 to the axle of the torsion-generating bevel gear 411. Moreover, the force-generating device 413 can spin simultaneously with the axle of the torsion-generating bevel gear 411 in a clockwise direction or in an anticlockwise direction. The force-generating device 413 throughputs an electric torsion into the torsion output axle 216 by rotating the axle of the torsion-generating bevel gear 411 and the first bevel gear 215. In detail, the torsion generated by the force-generating device 413 is outputted to the torsion output axle 216 because of the corresponding rotation of the axle of torsion-generating bevel gear 411 and the first bevel gear 215. Moreover, the axle of driven bevel gear 311 spins simultaneously with the first bevel gear 215 so that part of the power is transmitted to the scroll springs 313 by the simultaneous rotation of the axle of driven bevel gear 311. At the same time, the axle of the driven bevel gear 311 also spins simultaneously with the first bevel gear 215 so that part of the power provided by the force-generating device 413 can be saved inside the scroll springs 313 as a saved power for closing the door.

The restriction device 51 is disposed on an upper surface of the upper cover 219 and corresponds to the torsion output axle 216. Alternatively, the restriction device 51 can be disposed on an upper surface of the bottom cover 220 on the bottom torsion-outputting end 214. The restriction device 51 comprises a positioning block 511, a plurality of positioning posts 512, and a rotary rod 513 corresponding to the torsion output axle 216. The rotary rod 513 is disposed between the positioning block 511 and the positioning posts 512 so as to limit the rotary angle of the rotary rod 513 (i.e. the rotary rod 513 cannot rotate 360 degrees). A plurality of locking holes 227 are disposed on the upper surfaces of the upper cover 219 and the bottom cover 220 so as to provide for the movement of the positioning block 511. The positioning posts 512 are fixed on the positioning block 511 to limit the rotary angle. The rotary rod 513 is concentrically fixed on each of the upper output end 217 and the bottom output end 218 of the torsion output axle 216 so that the rotary rod 513 can only rotate between the positioning block 511 and the positioning posts 512. Furthermore, the opened/closed angle and position of the door are determined based upon the limited movement of the rotary rod 513. Accordingly, a user can adjust the restriction device 51 to control the opened angle and position of the door without disposing any other blocks on the ground.

To sum up, the main feature of the invention is that the left hole 223 and the right hole 224 are respectively disposed on the force-generating input end 211 and force-driven input end 212 of the cross body, and the left hole 223 and the right hole 224 are concentric and horizontal. The horizontal concentric axis 225 is defined via the centers of the left hole 223 and the right hole 224. The vertical through hole 221 is formed from the upper torsion-outputting end 213 to the bottom torsion-outputting end 214 and the vertical concentric axis 222 is defined inside the vertical through hole 221. Moreover, the vertical concentric axis 222 and the horizontal concentric axis 225 cross each other to form the center point 226. From a viewpoint of the center point 226, the axle of the torsion-generating bevel gear 411 of the force-generating mechanism 41 and the axle of the driven bevel gear 311 of the torsion-driven mechanism 31 spin in opposite directions and correspondingly to the center point 226. The torsion can be outputted from the upper and bottom ends of the torsion output axle 216 via the first bevel gear 215 and the power is saved for automatically closing/opening the door.

Furthermore, one end of the torsion output axle 216 connects the automatic door to automatically open or close the door, and the other end of the torsion output axle 216 is connected with the restriction device 51 concentrically. The rotary rod 513 can spin simultaneously with the door. Depending on the structure, the movement of the rotary rod 513 is limited via the positioning block 511 and the positioning posts 512 and further the opened angle of the door is limited within a predetermined range. A user no longer requires a doorstop or a block disposed on the ground or on the wall to stop the rotation of the door.

Figure 3:
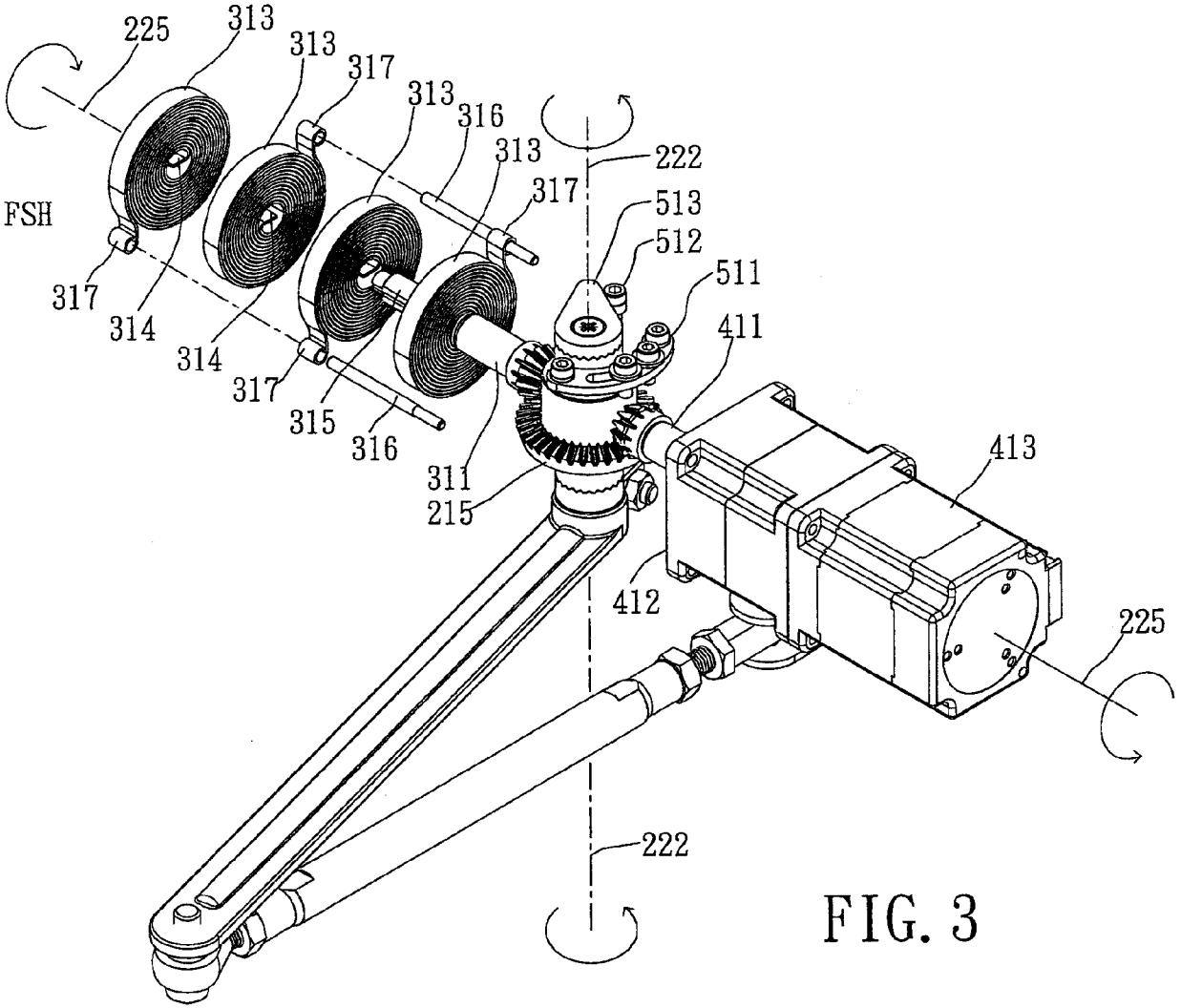
FIG. 3 is a perspective view showing that the scroll springs rolled up in accordance with the present invention.

Please refer to FIG. 3. The scroll springs 313 inside the main body unit of the torsion-driven mechanism 31 are all stressed inwardly so as to be rolled up. The scroll springs 313 are disposed concentrically on a connecting end of a driven axle 315 of the axle of the driven bevel gear 311. The axle of the driven bevel gear 311 is driven to spin by torsion that is transmitted through the first bevel gear 215. The axle of the driven bevel gear 311 spins in a reverse direction at 180 degrees against the axle of the torsion-generating bevel gear 411. The scroll springs 313 simultaneously spin with the axle of the driven bevel gear 311 and the connecting end of the driven axle 315 so that the scroll springs 313 are rolled up to store energy for automatically closing the door.

Figure 4:
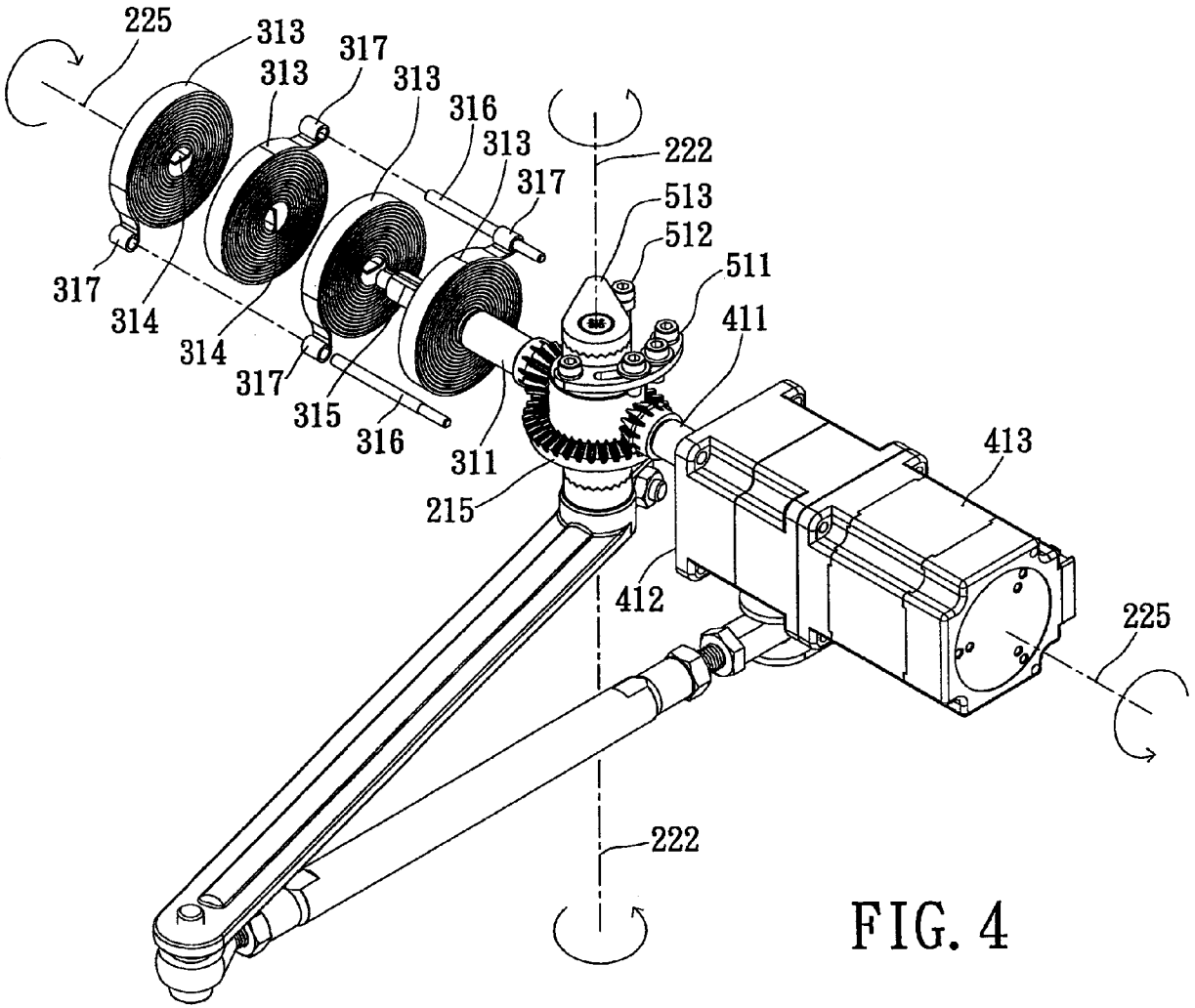
FIG. 4 is a perspective view showing some of the scroll springs rolled up and some unrolled in accordance with the present invention.

As shown in FIG. 4, some of the scroll springs 313 are rolled up and some are unrolled. The scroll springs 313 are disposed concentrically on a connecting end of the driven axle 315 of the axle of the driven bevel gear 311. The axle of the driven bevel gear 311 is driven by torsion that is transmitted through the first bevel gear 215. The axle of the driven bevel gear 311 spins in a reverse direction at 180 degrees against the axle of the torsion-generating bevel gear 411. The scroll springs 313 simultaneously spin with the axle of the driven bevel gear 311 and the connecting end of the driven axle 315 so that the scroll springs 313 are rolled up and/or unrolled to store energy for automatically closing the door.

Figure 5:
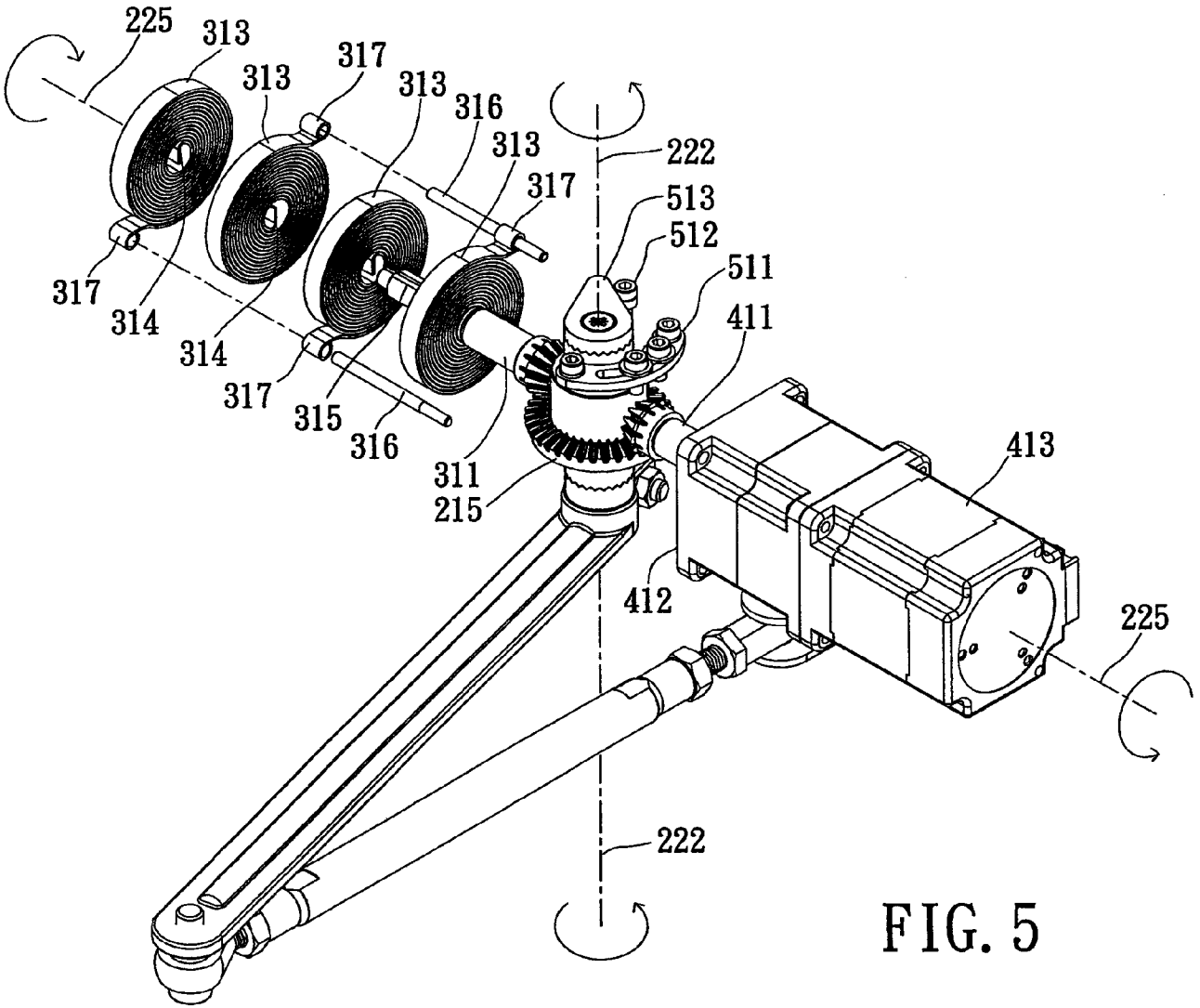
FIG. 5 is a perspective view showing that the scroll springs unrolled in accordance with the present invention.

Please refer to FIG. 5. The scroll springs 313 inside the main body unit of the torsion-driven mechanism 31 are all unrolled. The scroll springs 313 are disposed concentrically on a connecting end of the driven axle 315 of the axle of the driven bevel gear 311. The axle of the driven bevel gear 311 is driven by torsion that is transmitted through the first bevel gear 215. The axle of the driven bevel gear 311 spins in a reverse direction at 180 degrees against the axle of the torsion-generating bevel gear 411 and the scroll springs 313 simultaneously spin with the axle of the driven bevel gear 311 so that the scroll springs 313 are stressed outwardly to be unrolled so as to store energy for automatically closing the door.

Figure 6:
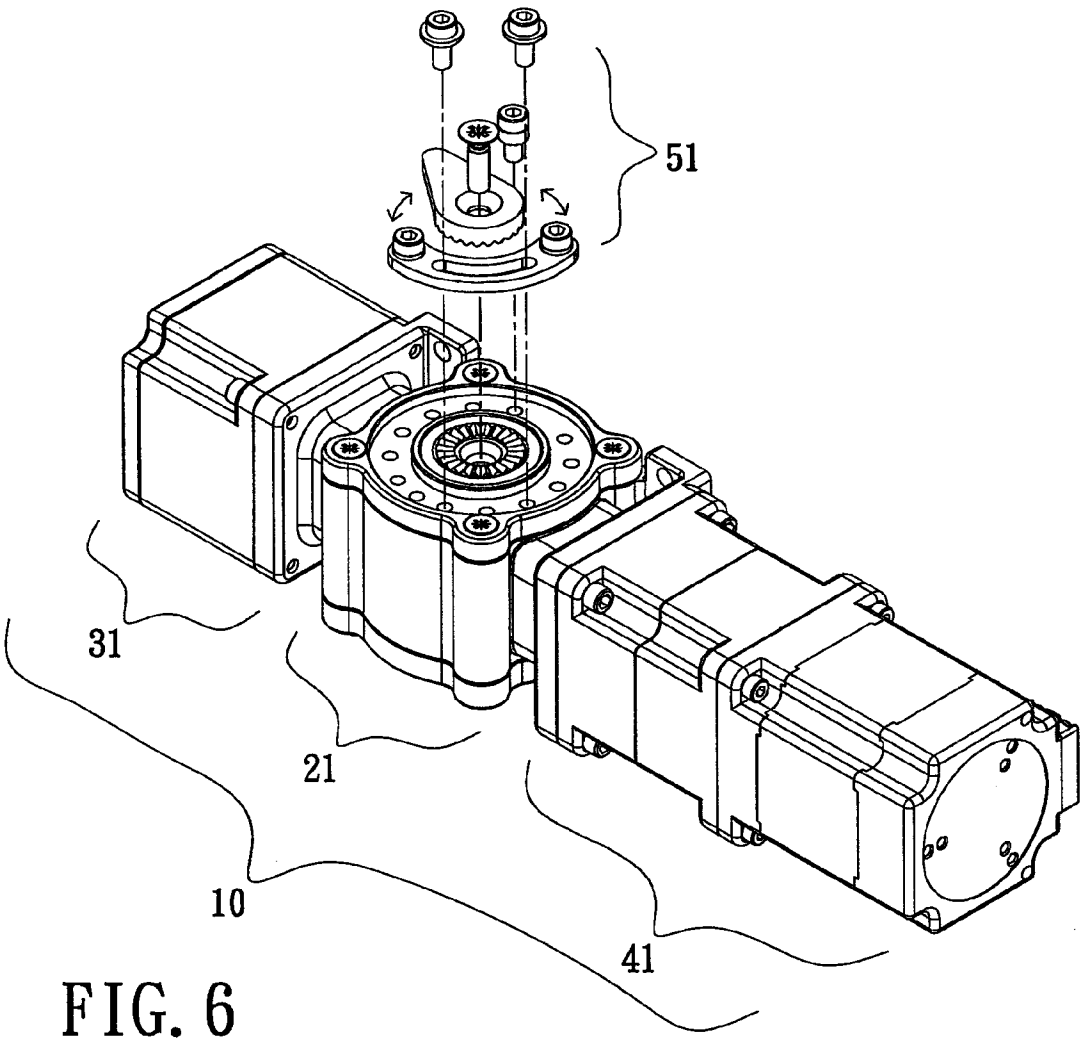
FIG. 6 is an assembled perspective view showing that the restriction device assembled with the upper cover in accordance with the present invention.
Figure 7:
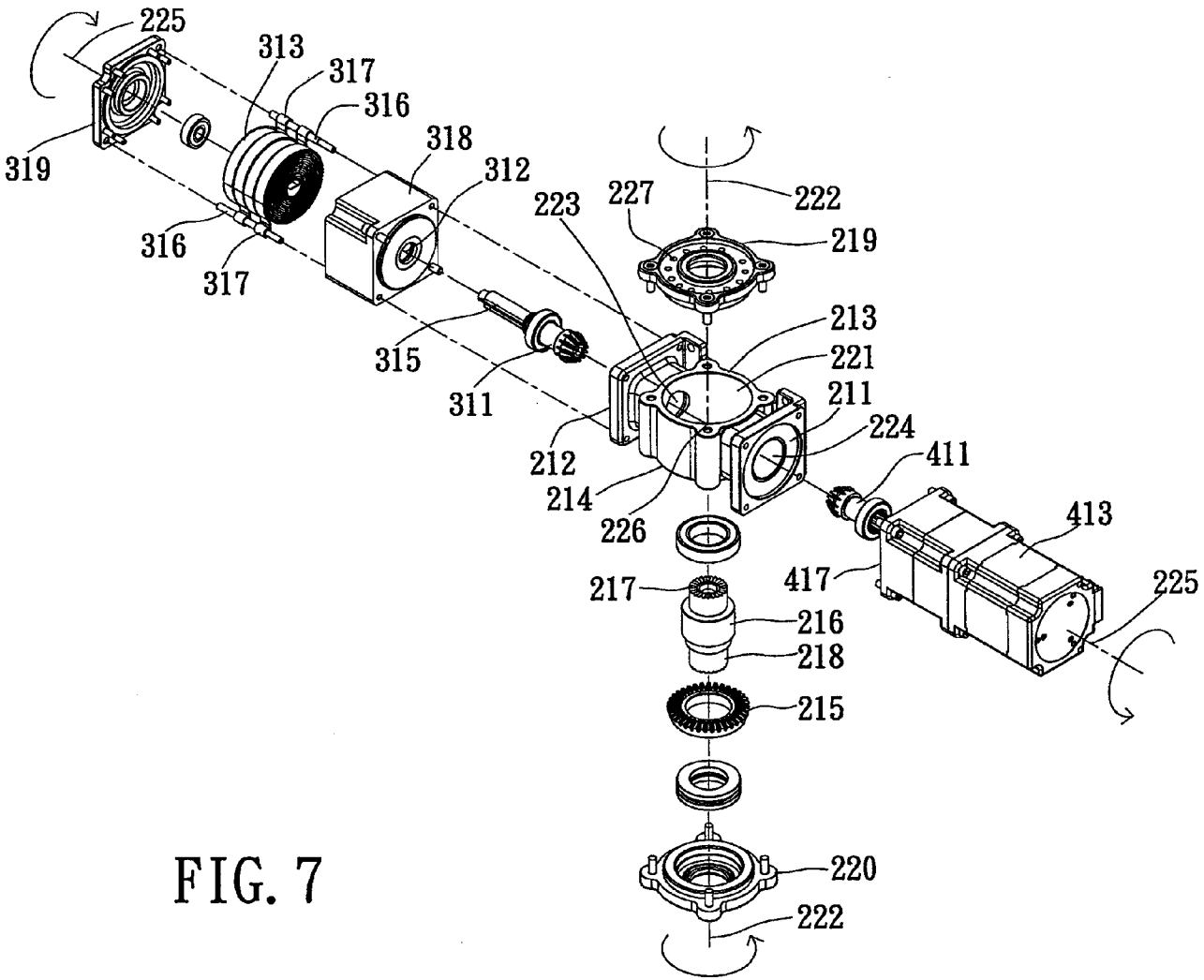
FIG. 7 is an exploded perspective view showing the concentric cross mechanism of the present invention excluding the restriction device.
Figure 8:
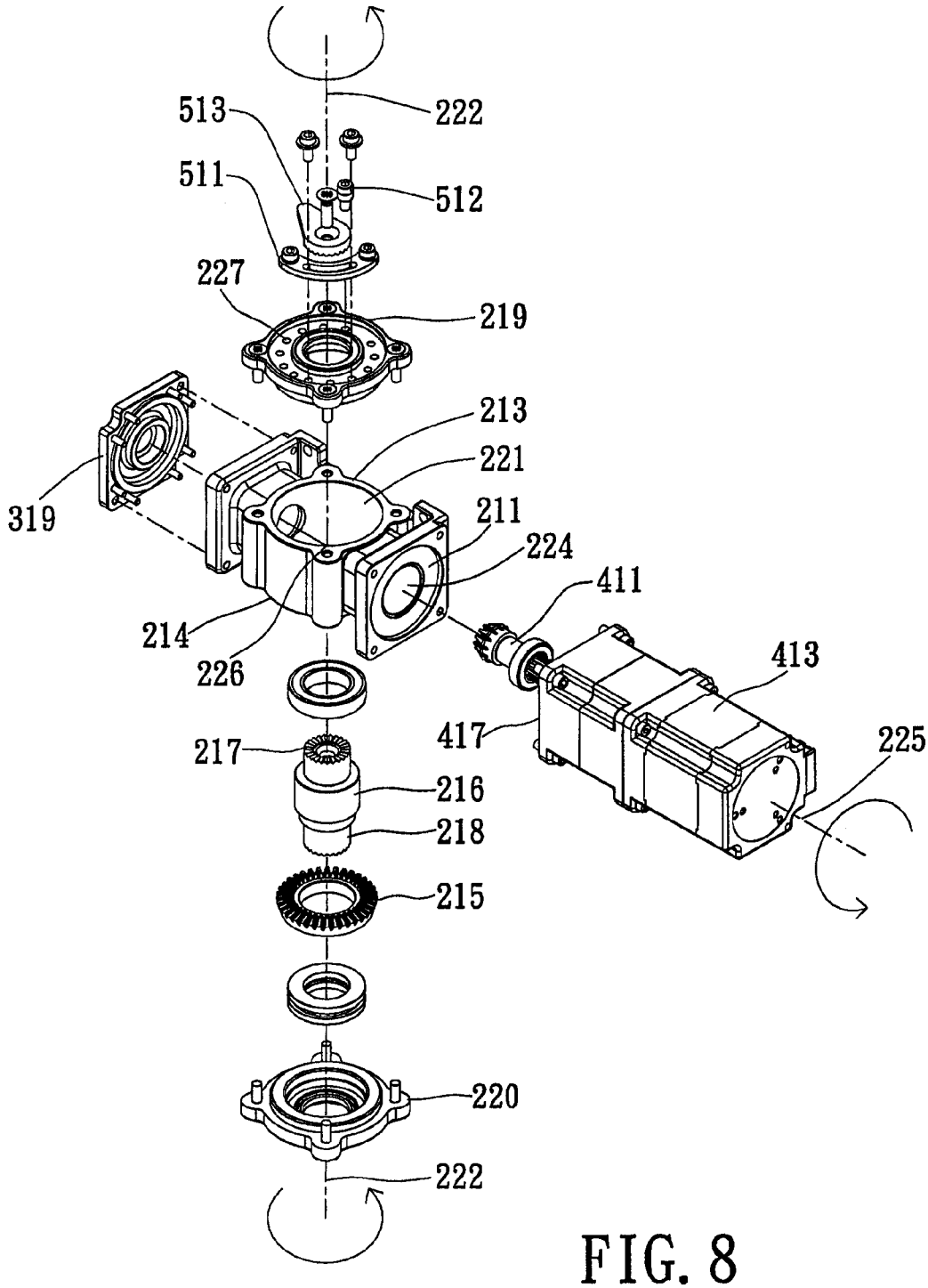
FIG. 8 is an exploded perspective view showing the concentric cross mechanism of the present invention excluding the main body unit of the torsion-driven mechanism.

Please refer to FIGS. 6 to 8. The positioning block 511 of the restriction device 51 can be disposed on the upper surface of the upper cover 219 or the upper surface of the bottom cover 220. In the embodiment, the positioning block 511 of the restriction device 51 is disposed on the upper surface of the upper cover 219 and on the position of a circle centered at the vertical concentric axis 222. The positioning block 511 corresponds to the positioning post 512 and both the positioning block 511 and the positioning post 512 can move right or left. The door is fixed on the rotary rod 513 disposed on the torsion output axle 216 and spins simultaneously therewith. The positioning block 511 and the positioning post 512 spins simultaneously with the door. The rotary rod 513 is fixed on the torsion output axle 216 and is disposed between the positioning block 511 and the positioning post 512. The maximum opened/closed angle of the door depends on the movement angle of the rotary rod 513 between the positioning block 511 and the positioning post 512. In other words, the positioning block 511 of the restriction device 51 can be alternatively disposed on the upper surface of the upper cover 219 or the upper surface of the bottom cover 220. Furthermore, the positioning block 511 is disposed on the position of a circle centered at the vertical concentric axis 222 and moves right and left. The positioning post 512 is disposed in a corresponding manner to the positioning block 511. The rotary rod 513 moves between the positioning block 511 and the positioning post 512 at a predetermined angle. Accordingly, the maximum opened/closed angle of the door depends on the predetermined angle.

In accordance with the present invention, the positioning block 511 of the restriction device 51 can be disposed on the upper surface of the upper cover 219 or the upper surface of the bottom cover 220 and can also be disposed on the position of a circle centered on the vertical concentric axis 222. A plurality of positioning post 512 is disposed in a corresponding manner to the positioning block 511. Both the positioning posts 512 and the positioning block 511 can move right and left. After the movement of the positioning post 512 and the positioning block 511, an angle is formed between the positioning post 512 and the positioning block 511 and the angle is provided for limiting the movement of the door. Furthermore, the rotary rod 513 is disposed between the positioning block 511 and the positioning post 512 and spins simultaneously with the torsion output axle 216 so that the torsion output axle 216 is driven to spin simultaneously with the rotary rod 513 so as to drive the door.

However, the concentric cross mechanism for the transiting torsion 10 can be used without the restriction device 51 depending on the user's requirements. In other words, the door is opened or closed via the main body unit of the concentric cross mechanism 21, the main body unit of a torsion-driven mechanism 31, and the main body unit of the force-generating mechanism 41 and the opened/closed angle of the door is not limited thereby.

Alternatively, the concentric cross mechanism for the transiting torsion 10 can be used without the main body unit of the torsion-driven mechanism 31 depending on the user's requirements. The door is opened/close via the main body unit of the concentric cross mechanism 21, the main body unit of the force-generating mechanism 41, and the restriction device 51. The door is only controlled by the main body unit of the force-generating mechanism 41. Because one end of the torsion output axle 216 is connected with the pushing/pulling rod 611 of the door, the pushing/pulling rod 611 spins simultaneously and concentrically with the torsion output axle 216. The rotary rod 513 of the restriction device 51 spins simultaneously and concentrically with the other end of the torsion output axle 216 and rotates in the same direction with the torsion output axle 216.

Alternatively, one end of the torsion output axle 216 is connected with a vertical spinning axle of the door, and the vertical spinning axle of the door spins simultaneously and concentrically with the rotary rod 513 of the restriction device 51.

Furthermore, one end of the torsion output axle 216 can simultaneously and concentrically drive the pushing/pulling rod 611 of the door to move due to the rotation.

The vertical spinning axle of the door is driven to spin simultaneously and concentrically with the torsion output axle 216 by the rotation of the torsion output axle 216 so as to open or close the door.

Further, in the present embodiment, the vertical spinning axle of the door is driven to spin simultaneously and concentrically with the torsion output axle 216 via the rotation of the torsion output axle 216 so as to open or close the door. Please refer to FIGS. 9 to 12. The concentric cross mechanism for the transiting torsion 10 is used for an automatic door in an opened or closed position by a user pushing or pulling the door. In accordance with the present invention, the concentric cross mechanism for the transiting torsion 10 incorporates with an operating mechanism of automatic doors 61. The operating mechanism of the automatic doors 61 comprises a pushing/pulling rod 611, a force-generating controller 612, an adaptor 613, and a base 615. The pushing/pulling rod 611 is connected with the main body unit of the concentric cross mechanism 21 to push or/and pull to close or/and open the door.

Figure 9:
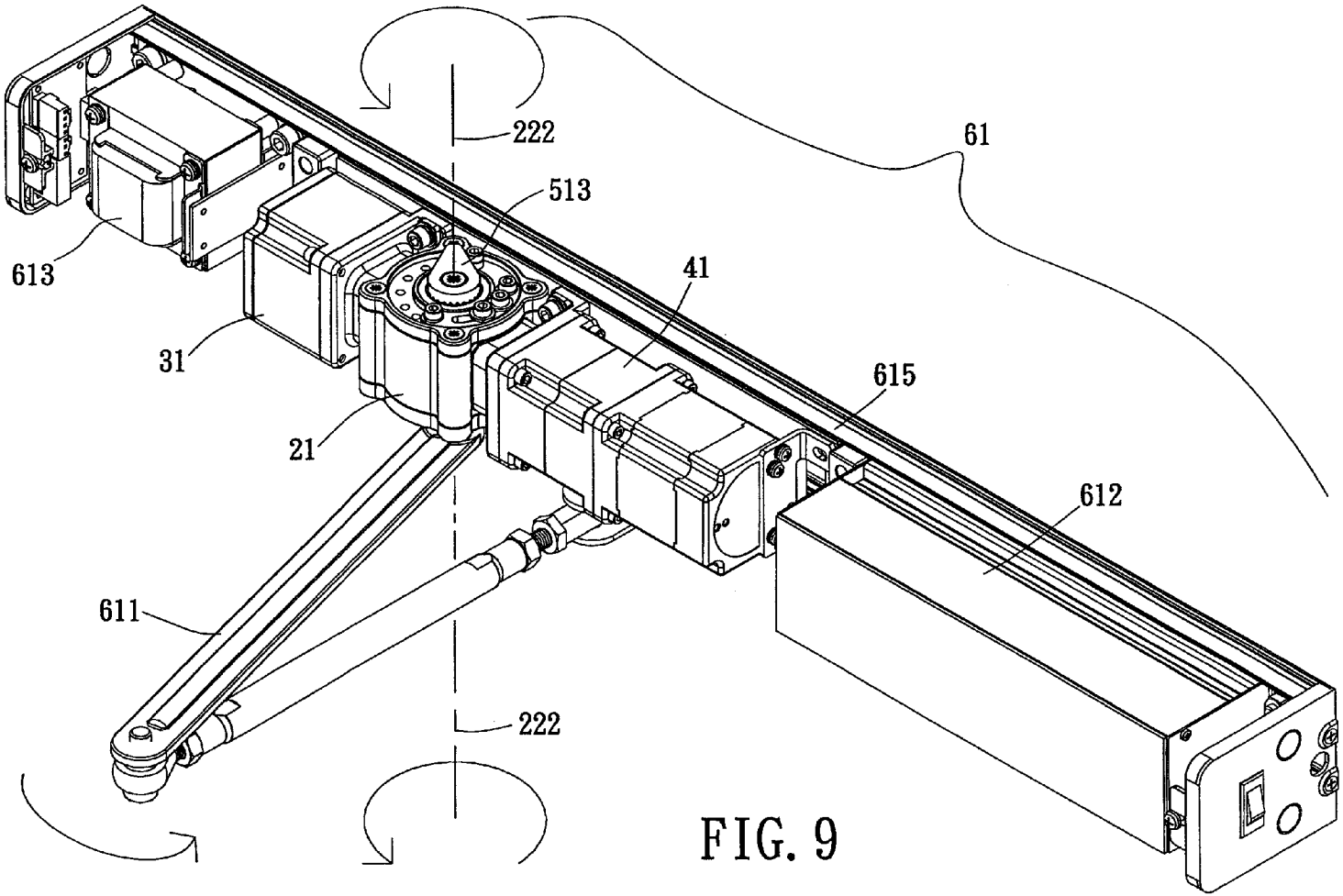
FIG. 9 is a perspective view showing the positions of the rotary rod of the restriction device and the pushing/pulling rod, when the door has been pulled from the opened position back to the closed position.
Figure 10:
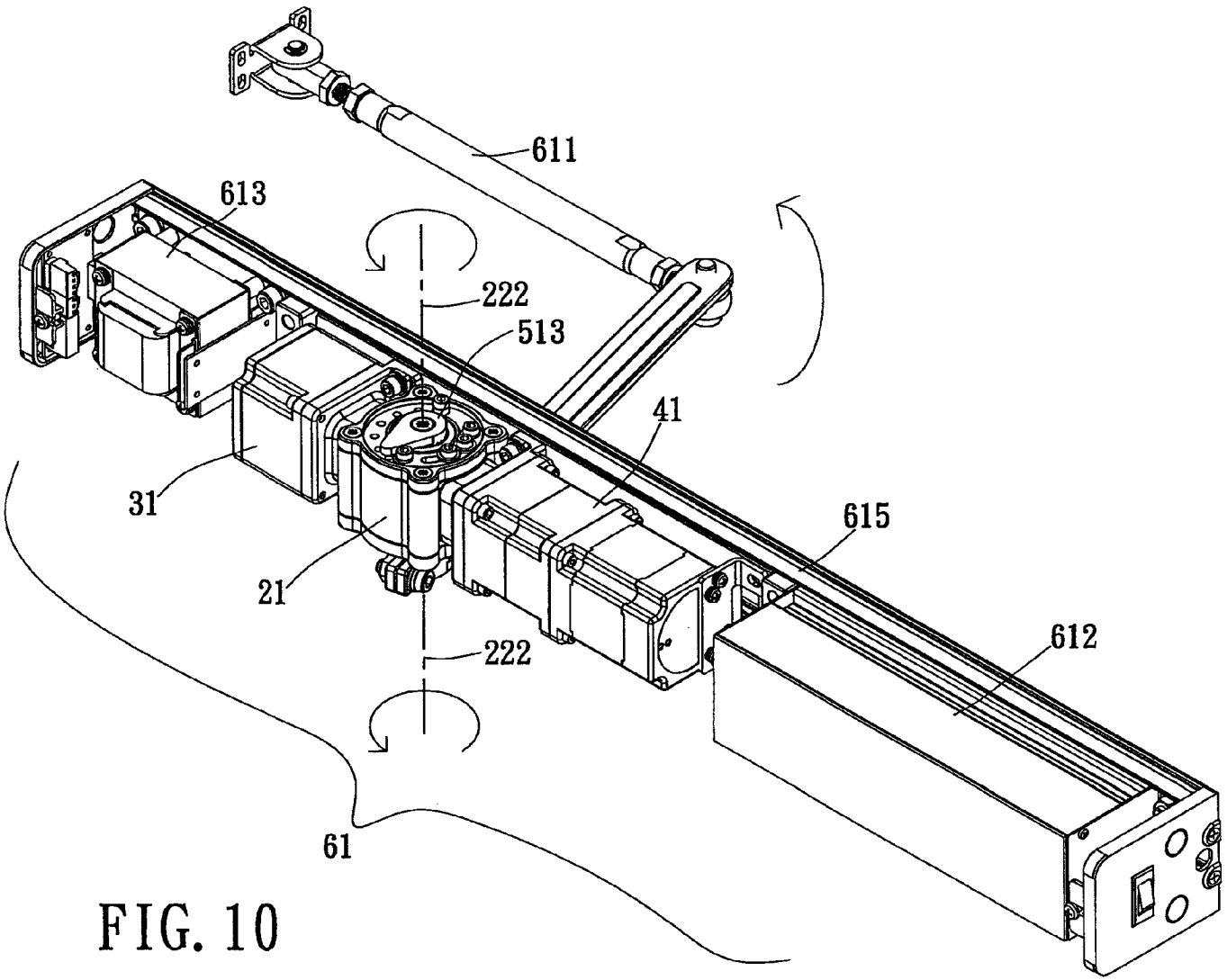
FIG. 10 is a perspective view showing the positions of the rotary rod of the restriction device and the pushing/pulling rod, when the door has been pushed to an opened state.

With reference to FIG. 9, the status of the rotary rod 513 of the restriction device 51 on the upper cover 219 and the pushing/pulling rod 611 are shown, when the automatic door is pulled from the opened position back to the closed position via the stored elastic force stored in the torsion-driven mechanism 31. With reference to FIG. 10, the status of the rotary rod 513 of the restriction device 51 on the upper cover 219 and the pushing/pulling rod 611 are shown when the automatic door is pushed to an opened position via the force generated by the force-generating mechanism 41.

Figure 11:
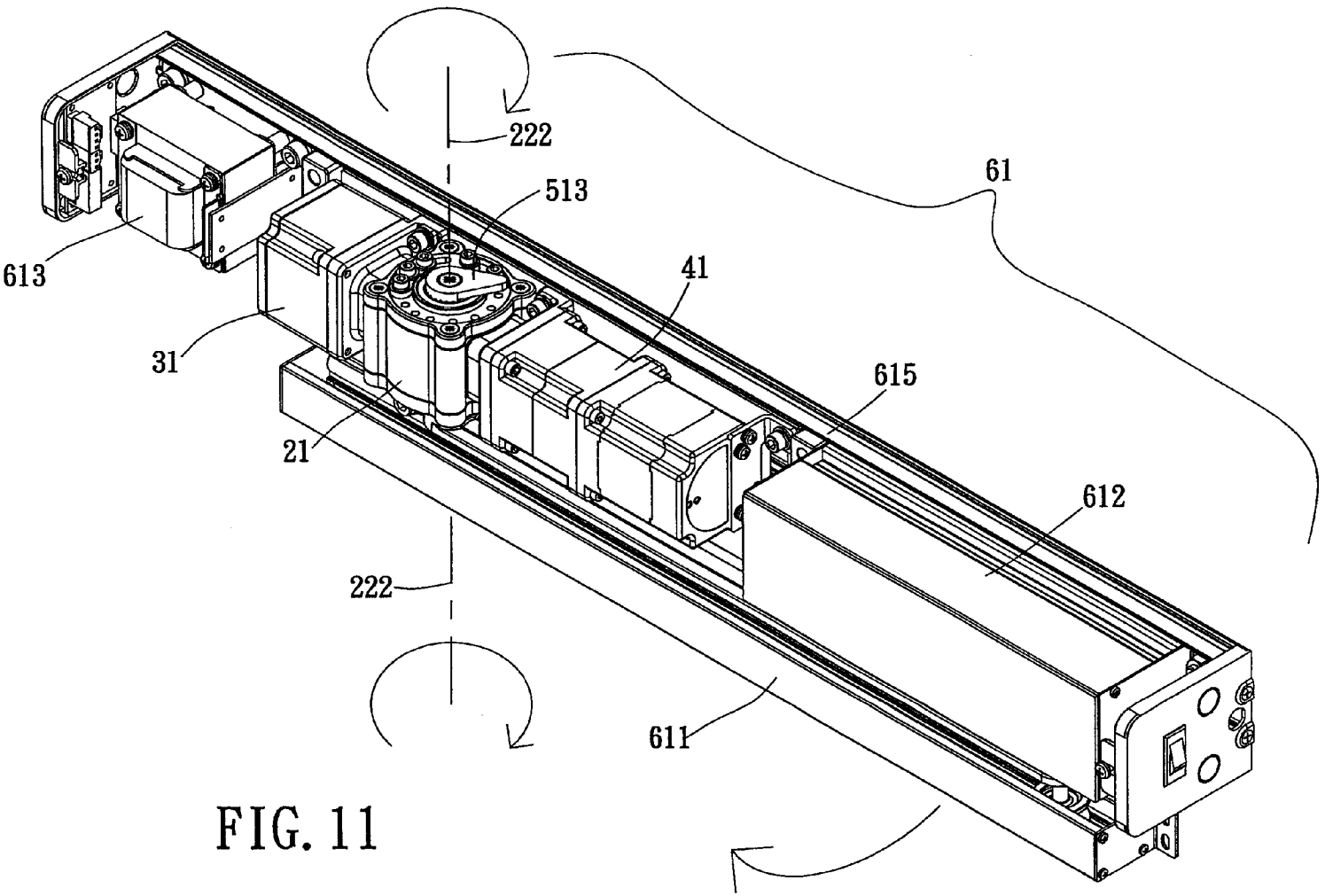
FIG. 11 is a perspective view showing the positions of the rotary rod of the restriction device and the pushing/pulling rod, when the door has been pulled from the opened position back to the closed position.

With reference to FIG. 11 the positions of the rotary rod 513 of the restriction device 51 on the upper cover 219 and the pushing/pulling rod 611 are shown when the automatic door is pulled from the opened position back to the closed position via the stored elastic force stored in the torsion-driven mechanism 31.

Figure 12:
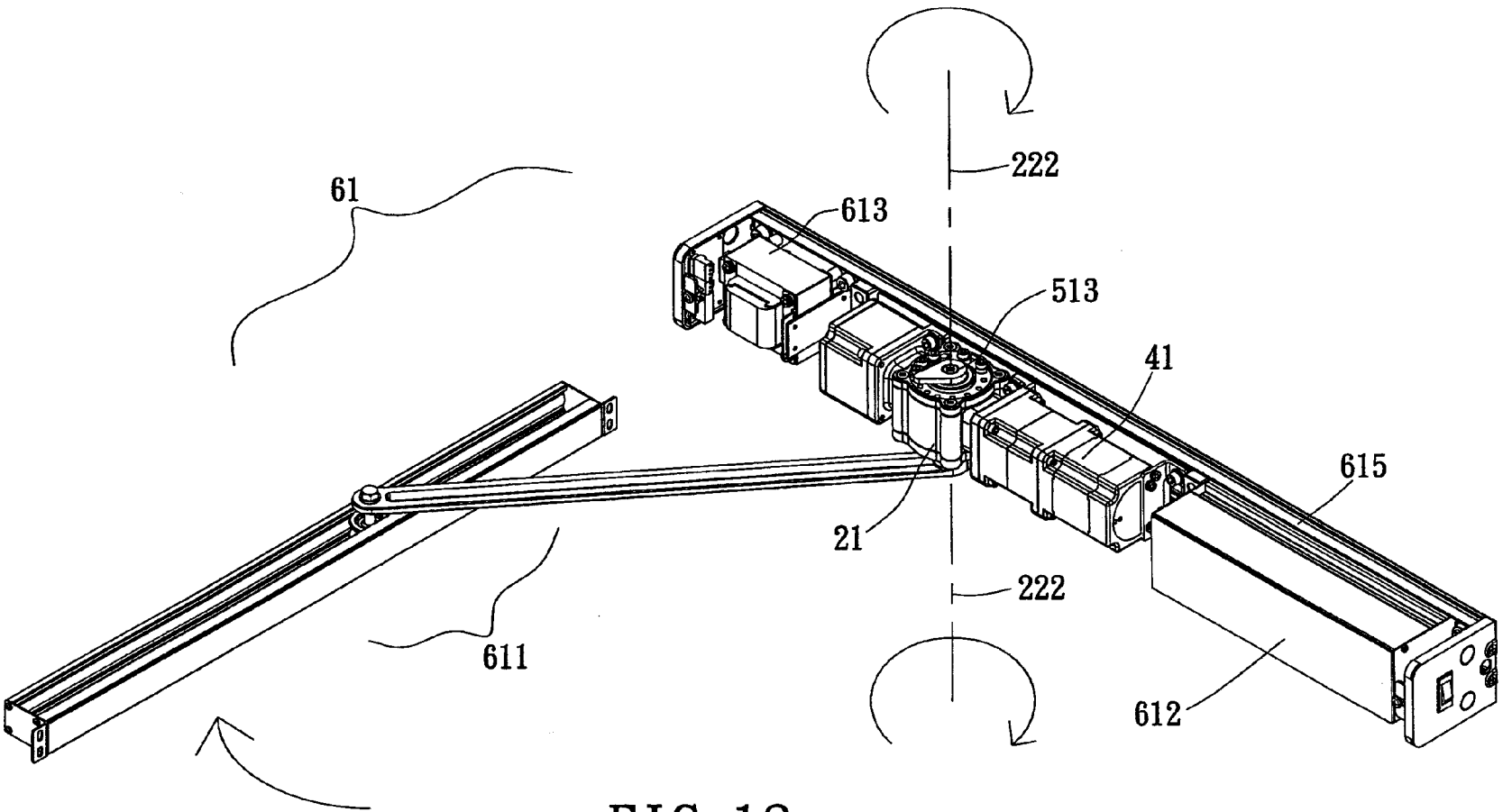
FIG. 12 is a perspective view showing the positions of the rotary rod of the restriction device and the pushing/pulling rod, when the door has been pushed to an opened state.

With reference to FIG. 12 the positions of the rotary rod 513 of the restriction device 51 on the upper cover 219 and the pushing/pulling rod 611 are shown when the automatic door is pushed to an opened position via the force generated by the force-generating mechanism 41.

According to the above description, the present invention utilizes units having simplified structures to control the door efficiently so as to open and close the door automatically and efficiently, and the size of the concentric cross mechanism for transiting torsion is reduced. Furthermore, the restriction device 51 and the pushing/pulling rod 611 can respectively disposed on and connected with the upper cover 219 and the bottom cover 220. The corresponding position of the positioning block 511 and the positioning post 512 of the restriction device 51 can be changed. Accordingly, the concentric cross mechanism for transiting torsion can be employed for a left-hand door or a right-hand door.

In other words, depending on the adjustment of the mentioned devices, the door can be pulled or/and pushed to close or/and open and the door is right-hand or left-hand. In other word, a user can push or pull the left-hand door via the left-hand of a user so as to swing the door. Alternatively, a user can push or pull the right-hand door via the right-hand of a user so as to swing the door.

Although the present invention has been described with reference to the foregoing preferred embodiments, it will be understood that the invention is not limited to the details thereof. Various equivalent variations and modifications may still occur to those skilled in this art in view of the teachings of the present invention. Thus, all such variations and equivalent modifications are also embraced within the scope of the invention as defined in the appended claims.

What is claimed is:

1. A concentric cross mechanism for transiting torsion, comprising:

a main body unit of the concentric cross mechanism, wherein the main body unit of the concentric cross mechanism comprises:

a cross body;

an upper cover disposed on an upper side of the cross body;

a bottom cover disposed on a bottom side of the cross body;

a torsion output axle disposed inside the cross body and corresponding to the upper cover and the bottom cover; and a first bevel gear mated with the torsion output axle;

a main body unit of a torsion-driven mechanism, wherein the main body unit of the torsion-driven mechanism is disposed on a side of the cross body, the main body unit of the torsion-driven mechanism comprises:

a casing for the torsion-driven mechanism;

an axle of the driven bevel gear disposed inside the casing for the torsion-driven mechanism; and at least one scroll spring disposed inside the casing for the torsion-driven mechanism and corresponding to the axle of the driven bevel gear;

a main body unit of a force-generating mechanism, wherein the main body unit of the force-generating mechanism is disposed on a second side of the cross body and corresponds to the main body unit of the torsion-driven mechanism, the main body unit of the force-generating mechanism comprises:

an axle of the torsion-generating bevel gear; and a force-generating device connected to the axle of the torsion-generating bevel gear and providing a power source thereto; and a restriction device disposed on either the upper cover and the bottom cover and corresponding to the torsion output axle, wherein the restriction device comprises:

a positioning block;

a positioning post; and a rotary rod mated with the torsion output axle, wherein the rotary rod is disposed between the positioning block and the positioning post, whereby the rotation angle of the rotary rod is limited;

wherein a left side and a right side of the main body unit of the concentric cross mechanism each respectively have a concentric hole, a horizontal concentric axis is defined inside the horizontal space of the cross body via centers of the holes on the left side and the right side, middle portions of an upper side and a bottom side of the main body unit of the concentric cross mechanism respectively have a hole, a vertical concentric axis is defined inside the vertical space of the cross body via centers of the holes on the upper side and the bottom side, a center point is defined by crossing the vertical concentric axis and the horizontal concentric axis;

wherein the first bevel gear respectively mates with the axle of the torsion-generating bevel gear and the axle of the driven bevel gear, the axle of the torsion-generating bevel gear is disposed opposite to the axle of the driven bevel gear and the two axles spin in opposite directions, both the axle of the torsion-generating bevel gear and the axle of the driven bevel gear transit a torsion to the first bevel gear and the first bevel gear outputs the torsion from an upper end and a bottom end of the torsion output axle;

wherein when an automatic door is driven to be opened via a torsion output end of the torsion output axle, the restriction device is connected with other torsion output end of the torsion output axle whereby the door spins simultaneously with the rotary rod, the door is limited to swing at a predetermined angle range depending that the rotary rod spins between the positioning block and the positioning post.

2. The concentric cross mechanism for transiting torsion according to claim 1, wherein the main body unit of the torsion-driven mechanism comprises a plurality of scroll springs connected with the axle of the driven bevel gear so as to receive the torsion transited by the first bevel gear and spin simultaneously with the axle of the driven bevel gear and to save the torsion, wherein the axle of the driven bevel gear spins in a reverse direction with the axle of the torsion-generating bevel gear and the scroll springs are rolled up.

3. The concentric cross mechanism for transiting torsion according to claim 1, wherein the main body unit of the torsion-driven mechanism comprises a plurality of scroll springs connected with the axle of the driven bevel gear so as to receive the torsion transited by the first bevel gear and spin simultaneously with the axle of the driven bevel gear and to save the torsion, wherein the axle of the driven bevel gear spins in a reverse direction with the axle of the torsion-generating bevel gear and some of the scroll springs are rolled up and the others are unrolled so that the torsion is saved in the rolled and unrolled scroll springs.

4. The concentric cross mechanism for transiting torsion according to claim 1, wherein the main body unit of the torsion-driven mechanism comprises a plurality of scroll springs connected with the axle of the driven bevel gear so as to receive the torsion transited by the first bevel gear and spin simultaneously with the axle of the driven bevel gear and to save the torsion, wherein the axle of the driven bevel gear spins in a reverse direction with the axle of the torsion-generating bevel gear and the scroll springs are unrolled so that the torsion is saved in the unrolled scroll springs.

5. The concentric cross mechanism for transiting torsion according to claim 1, wherein the positioning block of the restriction device is disposed on the upper cover or on the bottom cover and is at the position of a circle centered at the vertical concentric axis, the positioning post is disposed correspondingly to the positioning block and both the positioning post and the positioning block move right and left, the rotary rod fixed on the torsion output axle is disposed between the positioning block and the positioning post, a rotary angle of the rotary rod between the positioning block and the positioning post is a maximum opened/closed angle of the door.

6. The concentric cross mechanism for transiting torsion according to claim 1, wherein the positioning block of the restriction device is disposed on the upper cover or on the bottom cover and is at the position of a circle centered at the vertical concentric axis, the positioning post is disposed correspondingly to the positioning block and both the positioning post and the positioning block move right and left, the rotary rod fixed on the torsion output axle is disposed between the positioning block and the positioning post, a rotary angle of the rotary rod between the positioning block and the positioning post is a maximum opened angle of the door.

7. The concentric cross mechanism for transiting torsion according to claim 1, wherein one end of the torsion output axle is connected with a pushing/pulling rod of the door so as to drive the pushing/pulling rod to spin simultaneously and concentrically with the torsion output axle, and the other end of the torsion output axle is connected with the rotary rod of the restriction device so as to drive the rotary rod to spin simultaneously and concentrically with the torsion output axle.

8. The concentric cross mechanism for transiting torsion according to claim 1, wherein one end of the torsion output axle is concentrically connected with a vertical spinning axle of the door so as to drive the door to spin simultaneously with the torsion output axle, and the other end of the torsion output axle is connected with the rotary rod of the restriction device so as to drive the rotary rod to spin simultaneously and concentrically with the torsion output axle.

9. A concentric cross mechanism for transiting torsion, comprising:

a main body unit of concentric cross mechanism, wherein the main body unit of the concentric cross mechanism comprises:

a cross body;

an upper cover disposed on an upper side of the cross body;

a bottom cover disposed on a bottom side of the cross body;

a torsion output axle disposed inside the cross body and corresponding to the upper cover and the bottom cover; and a first bevel gear mated with the torsion output axle;

a main body unit of the torsion-driven mechanism, wherein the main body unit of the torsion-driven mechanism is disposed on a side of the cross body, the main body unit of the torsion-driven mechanism comprises:

a casing for the torsion-driven mechanism;

an axle of the driven bevel gear disposed inside the casing for the torsion-driven mechanism; and at least one scroll spring disposed inside the casing for the torsion-driven mechanism and corresponding to the axle of the driven bevel gear; and a main body unit of the force-generating mechanism, wherein the main body unit of the force-generating mechanism is disposed on a second side of the cross body and corresponds to the main body unit of the torsion-driven mechanism, the main body unit of the force-generating mechanism comprises:

an axle of the torsion-generating bevel gear; and a force-generating device connected to the axle of the torsion-generating bevel gear and providing a power source thereto;

wherein a left side and a right side of the main body unit of the concentric cross mechanism each respectively have a hole, a horizontal concentric axis is defined inside the horizontal space of the cross body via centers of the holes on the left side and the right side, middle portions of an upper side and a bottom side of the main body unit of the concentric cross mechanism respectively have a hole, a vertical concentric axis is defined inside the vertical space of the cross body via centers of the holes on the upper side and the bottom side, a center point is defined by crossing the vertical concentric axis and the horizontal concentric axis;

wherein the first bevel gear respectively mates with the axle of the torsion-generating bevel gear and the axle of the driven bevel gear, the axle of the torsion-generating bevel gear is opposite to the axle of the driven bevel gear and the two axles spin in opposite directions, both the axle of the torsion-generating bevel gear and the axle of the driven bevel gear transit a torsion to the first bevel gear and the first bevel gear outputs the torsion from an upper end and a bottom end of the torsion output axle.

10. The concentric cross mechanism for transiting torsion according to claim 9, wherein the main body unit of the torsion-driven mechanism comprises a plurality of scroll springs connected with the axle of the driven bevel gear so as to receive the torsion transited by the first bevel gear and spin simultaneously with the axle of the driven bevel gear and to save the torsion, wherein the axle of the driven bevel gear spins in a reverse direction with the axle of the torsion-generating bevel gear and the scroll springs are rolled up so as to save the torsion.

11. The concentric cross mechanism for transiting torsion according to claim 9, wherein the main body unit of the torsion-driven mechanism comprises a plurality of scroll springs connected with the axle of the driven bevel gear so as to receive the torsion transited by the first bevel gear and spin simultaneously with the axle of the driven bevel gear and to save the torsion, wherein the axle of the driven bevel gear spins in a reverse direction with the axle of the torsion-generating bevel gear and some of the scroll springs are rolled up and the other scroll springs are unrolled so that the torsion is saved in the rolled and unrolled scroll springs.

12. The concentric cross mechanism for transiting torsion according to claim 9, wherein the main body unit of the torsion-driven mechanism comprises a plurality of scroll springs connected with the axle of the driven bevel gear so as to receive the torsion transited by the first bevel gear and spin simultaneously with the axle of the driven bevel gear and to save the torsion, wherein the axle of the driven bevel gear spins in a reverse direction with the axle of the torsion-generating bevel gear and the scroll springs are unrolled so that the torsion is saved in the unrolled scroll springs.

13. The concentric cross mechanism for transiting torsion according to claim 9, wherein one end of the torsion output axle is connected with a pushing/pulling rod of the door so as to drive the pushing/pulling rod to spin simultaneously and concentrically with the torsion output axle.

14. The concentric cross mechanism for transiting torsion according to claim 9, wherein one end of the torsion output axle is concentrically connected with a vertical spinning axle of the door of the door so as to drive the door to spin simultaneously with the torsion output axle.

15. A concentric cross mechanism for transiting torsion, comprising:

a main body unit of concentric cross mechanism, wherein the main body unit of the concentric cross mechanism comprises:

a cross body;

an upper cover disposed on an upper side of the cross body;

a bottom cover disposed on a bottom side of the cross body;

a torsion output axle disposed inside the cross body and corresponding to the upper cover and the bottom cover; and a first bevel gear mated with the torsion output axle;

a main body unit of the force-generating mechanism, wherein the main body unit of the force-generating mechanism is disposed on a side of the cross body, the main body unit of the force-generating mechanism comprises:

an axle of the torsion-generating bevel gear; and a force-generating device connected to the axle of the torsion-generating bevel gear and providing a power source thereto; and a restriction device disposed on each of the upper cover and the bottom cover and corresponding to the torsion output axle, wherein the restriction device comprises:

a positioning block;

a positioning post; and a rotary rod mated with the torsion output axle, wherein the rotary rod is disposed between the positioning block and the positioning post, whereby the rotation angle of the rotary rod is limited;

wherein a left side and a right side of the main body unit of the concentric cross mechanism each respectively have a hole, a horizontal concentric axis is defined inside the horizontal space of the cross body via centers of the holes on the left side and the right side, middle portions of an upper side and a bottom side of the main body unit of the concentric cross mechanism each respectively have a hole, a vertical concentric axis is defined inside the vertical space of the cross body via centers of the holes on the upper side and the bottom side, a center point is defined by crossing the vertical concentric axis and the horizontal concentric axis;

wherein the first bevel gear mates with the axle of the torsion-generating bevel gear, the axle of the torsion-generating bevel gear is corresponding to the center point and spins in a predetermined direction opposite to a direction of a torsion so as to transit the torsion to the first bevel gear, the first bevel gear outputs the torsion from an upper end and a bottom end of the torsion output axle;

wherein when an automatic door is driven to be opened via a torsion output end of the torsion output axle, the restriction device is connected with other torsion output end of the torsion output axle whereby the door spins simultaneously with the rotary rod, the door is limited to swing at a predetermined angle range depending that the rotary rod spins between the positioning block and the positioning post.

16. The concentric cross mechanism for transiting torsion according to claim 15, wherein the positioning block of the restriction device is disposed on the upper cover or on the bottom cover and is at the position of a circle centered at the vertical concentric axis, the positioning post is disposed correspondingly to the positioning block and both the positioning post and the positioning block move right and left on the cover, the rotary rod fixed on the torsion output axle is disposed between the positioning block and the positioning post, a rotary angle of the rotary rod is between the positioning block and the positioning post is a maximum opened/closed angle of the door.

17. The concentric cross mechanism for transiting torsion according to claim 15, wherein the positioning block of the restriction device is disposed on one of the upper cover and the bottom cover and is at the position of a circle centered at the vertical concentric axis, the positioning post is disposed correspondingly to the positioning block and both the positioning post and the positioning block move right and left, the rotary rod fixed on the torsion output axle is disposed between the positioning block and the positioning post, a rotary angle of the rotary rod between the positioning block and the positioning post is a maximum opened angle of the door.

18. The concentric cross mechanism for transiting torsion according to claim 15, wherein one end of the torsion output axle is connected with a pushing/pulling rod of the door so as to drive the pushing/pulling rod to spin simultaneously and concentrically with the torsion output axle, and the other end of the torsion output axle is connected with the rotary rod of the restriction device so as to drive the rotary rod to spin simultaneously and concentrically with the torsion output axle.

19. The concentric cross mechanism for transiting torsion according to claim 15, wherein one end of the torsion output axle is concentrically connected with a vertical spinning axle of the door of the door so as to drive the door to spin simultaneously with the torsion output axle, and the other end of the torsion output axle is connected with the rotary rod of the restriction device so as to drive the rotary rod to spin simultaneously and concentrically with the torsion output axle.

* * * * *